US005609251A

United States Patent [19]

Harris

[11] Patent Number: 5,609,251

[45] Date of Patent: Mar. 11, 1997

[54] WRAP-AROUND CARRIER WITH PARTIAL END PANELS

[75] Inventor: Randall L. Harris, Powder Springs, Ga.

[73] Assignee: Riverwood International Corporation, Atlanta, Ga.

[21] Appl. No.: 566,236

[22] Filed: Dec. 1, 1995

[51] Int. Cl.[6] ..... B65D 71/00

[52] U.S. Cl. ..... 206/434; 206/141; 206/152

[58] Field of Search ..... 206/141, 162, 206/434, 167, 152, 139

[56] References Cited

U.S. PATENT DOCUMENTS

| | | | |
|---|---|---|---|
| 3,203,584 | 8/1965 | Forrer | 229/243 |
| 3,204,814 | 9/1965 | Mahon | 206/162 |
| 3,219,183 | 11/1965 | Potter et al. | 206/162 |
| 3,747,835 | 7/1973 | Graser | 206/152 |
| 3,977,518 | 8/1976 | Arneson | 206/434 |
| 4,034,852 | 7/1977 | Forrer | 206/141 |
| 4,597,523 | 7/1986 | Schuster | 206/427 |
| 5,421,458 | 6/1995 | Campbell | 206/427 |

*Primary Examiner*—Jimmy G. Foster
*Assistant Examiner*—Nhan Lam

[57] ABSTRACT

A wrap-around carrier with partial end panels. The end panels are formed from portions of a carrier blank which normally would have been the end portions of the top panel. Instead, these portions are connected to the side panels along diagonal fold lines and folded down into place during forming of the carrier. The end articles in the carrier are in contact with tuck panel connections of the end panels.

9 Claims, 4 Drawing Sheets

WRAP-AROUND CARRIER WITH PARTIAL END PANELS

FIELD OF THE INVENTION

This invention relates to wrap-around article carriers. More particularly, it relates to wrap-around article carriers which have partial end panels.

BACKGROUND OF THE INVENTION

Wrap-around carriers are commonly used in the packaging of beverage bottles and cans. To form a package a carrier blank is wrapped around a group of articles and the end portions of the blank are connected together, usually at the bottom of the carrier. The ends of the carrier typically are open, but because the blank is so tightly wrapped there is little risk of the articles falling out through the open ends. Wrap-around carriers are structurally sound and are economical, making them ideal carriers for certain products.

A problem which has been created by the practice of scanning the price codes on merchandise at the check-out counters of retail outlets has led to a demand for wrap-around carriers with partial end panels which cover the code on the end articles in the package. This allows the scanner to see only the price code on the carrier itself rather than erroneously scanning the price code on an end article in the carrier. Although normally not needed to prevent articles from escaping from a carrier, the provision of partial end panels provides extra insurance against that risk.

Wrap-around carriers have been provided with partial end panels by various means, most commonly by connecting 30, end panels to the blank through the use of gusset panels which allow the end panels to fold into place as the blank is wrapped around the articles. This has resulted in an increase in the cost of the blanks due to the need for additional material to form the end panels and the gusset panels.

It would be highly desirable to be able to provide wrap-around carriers with partial end panels without increasing the cost of the carrier blanks, and it is the primary object of this invention to provide such a carrier.

BRIEF SUMMARY OF THE INVENTION

The invention is incorporated in a wrap-around carrier containing a plurality of articles. The carrier includes a top panel, opposite side panels foldably connected to the top panel, a bottom panel connected to the side panels and end panels. The end edges of the top panel are spaced from the end panels and the carrier includes means for connecting the end panels to the side panels.

The latter means includes a tuck or connecting panel foldably connected to opposite end portions of each end panel and to an associated side panel, the connecting panels being located between an adjacent article in the package and the associated side panel. Preferably, the end panels include diagonal fold lines which extend inwardly from a point located at the upper end of an associated side panel. These diagonal fold lines permit the corner areas of the end panels to better follow the curved contour of adjacent articles in the package and also provide for major portions of the end panels to lie in a substantially vertical plane.

The carrier design provides for the end panels to be formed from portions of the carrier blank which normally would be part of the top panel section of the blank. This arrangement produces a top panel having end edges which are spaced from the end panels and results in the end panels having a height substantially equal to the distance that the end edges of the top panel are spaced from the end panels. The design is quite economical, requiring no additional blank material for the formation of the end panels.

These and other features and aspects of the invention, as well as other benefits, will readily be ascertained from the detailed description of the preferred embodiment described below.

DETAILED DESCRIPTION OF THE PREFERRED EMBODIMENT

Figure 1:
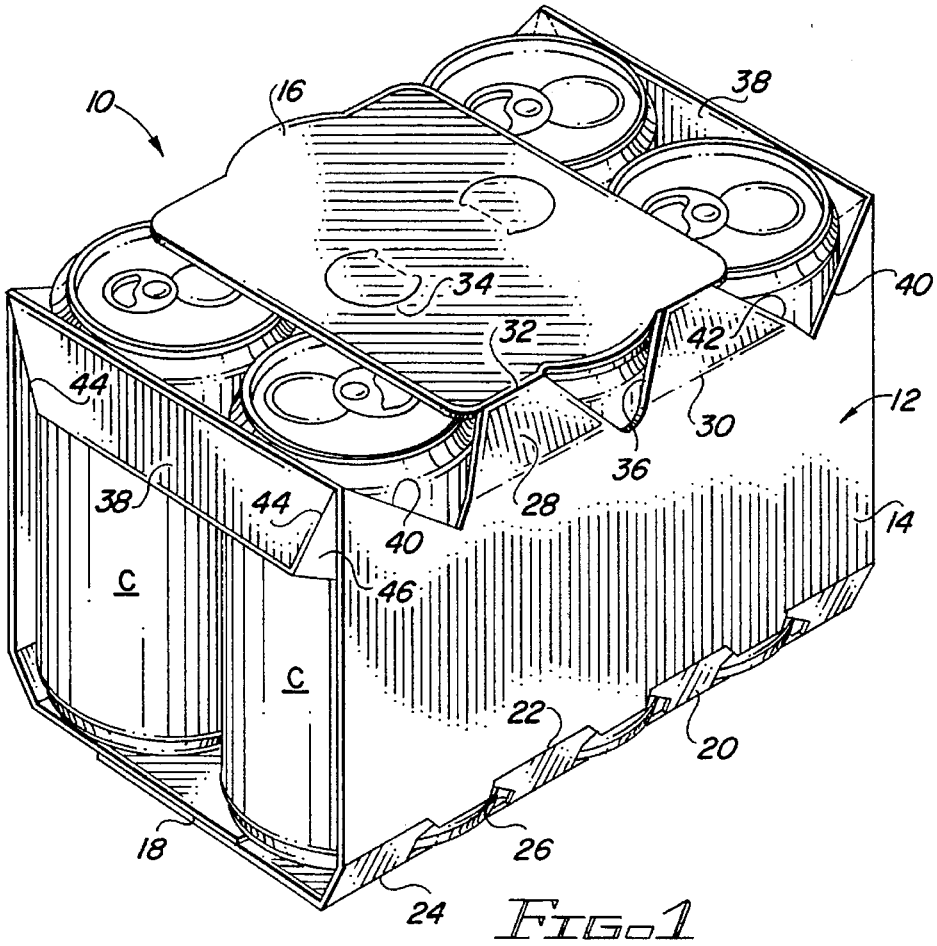
FIG. 1 is a pictorial view of the carrier of the invention, shown holding six beverage cans.
Figure 2:
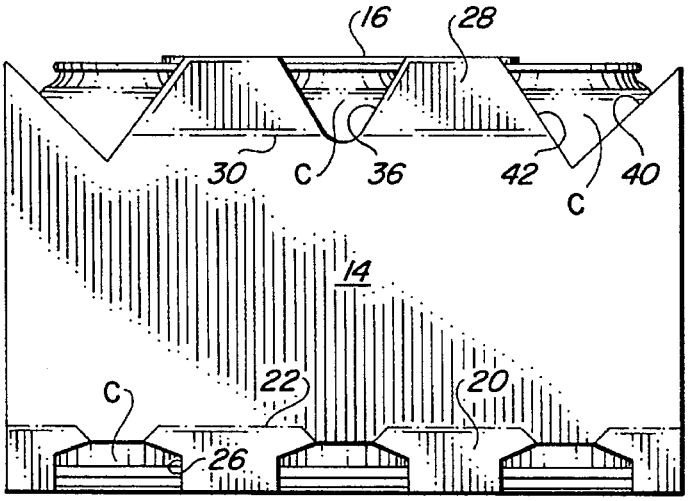
FIG. 2 is a side view of the carrier of FIG. 1.
Figure 3:
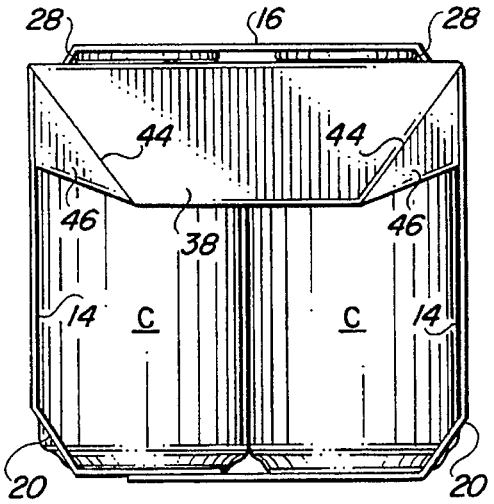
FIG. 3 is an end view of the carrier of FIG. 1.
Figure 4:
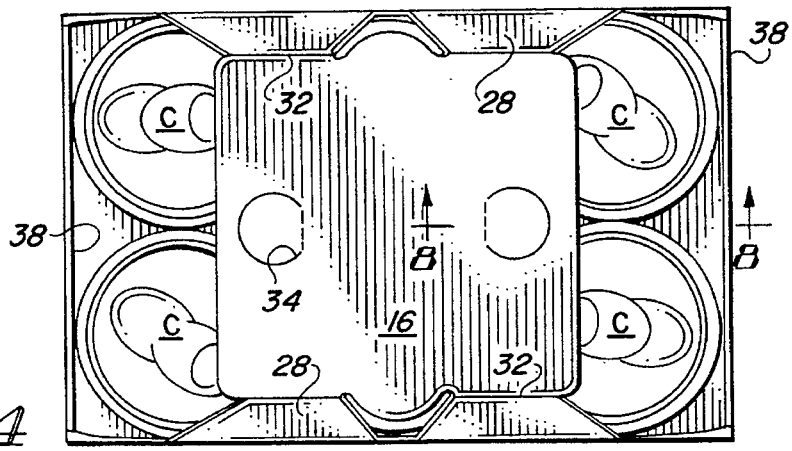
FIG. 4 is a top view of the carrier of FIG. 1.

Referring to FIGS. 1–4, a package 10 is comprised of six beverage cans C arranged in two rows of three cans each within wrap-around carrier 12. The carrier includes side panels 14 connected to top panel 16 and to bottom panel 18. The side panels include a lower bevel panel 20 which is connected by fold line 22 to the main vertical portion of the side panels and by fold line 24 to the bottom panel. Heel cutouts 26 are provided in the bevel panels 20 through which the bottom portions of the cans protrude in typical wrap-around carrier fashion. In addition, the side panels include an upper bevel panel 28 which is connected by fold line 30 to the main vertical portion of the side panels and by fold line 32 to the top panel 16. The top panel, which includes finger holes 34, is relatively short, not extending the full length of the carrier, as is the case with the upper bevel panel 28. The top portions of the interior cans protrude through a cutout 36 in the central portion of each upper bevel panel, which permits the carrier to be tightly drawn about the cans.

The carrier includes end panels 38 which are foldably connected to the side panels 14 along the outer edge 40 of notches or openings 42 in the upper end portions of the side panels. Angled fold lines 44 form triangular panels 46 in the end panels, which, along with the end panel connections, are discussed in more detail below. The end portions of the side panels to which the end panels are connected are part of the vertical portion of the side panel and do not include the bevel panel portions 28.

Figure 5:
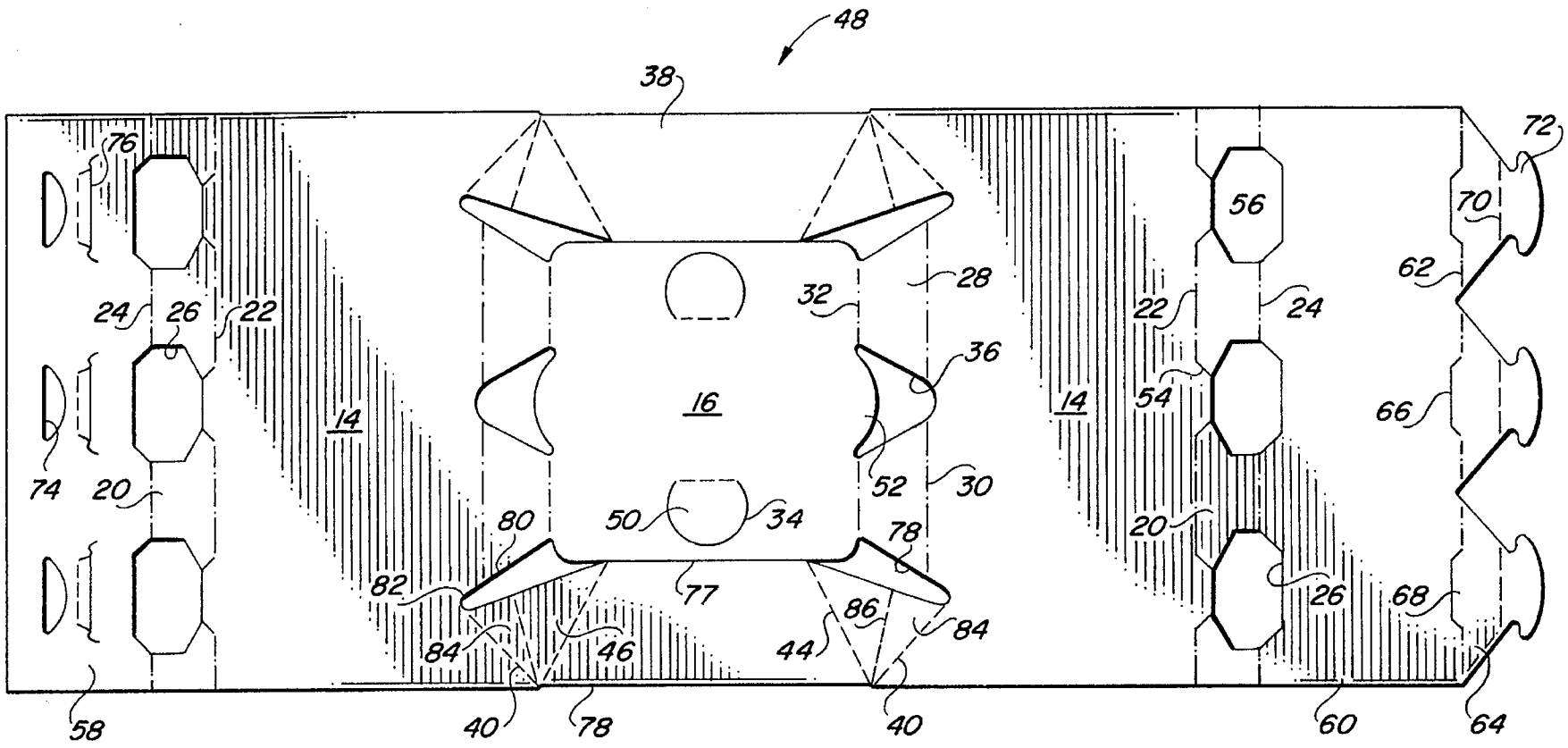
FIG. 5 is a plan view of a blank for forming the carrier of FIG. 1.

Referring now to FIG. 5, a blank 48 for forming the carrier is of substantially rectangular shape and may be comprised of any suitable material having adequate strength and flexibility. Preferably, the blank is comprised of paperboard of the caliper and type conventionally utilized in the beverage carrier industry. The top panel section 16 is located centrally of the blank and is connected at opposite sides by fold lines 32 to the upper bevel panel portions 28 of the side panel sections 14. The finger holes 34 preferably are covered by flaps 50 foldably connected to the top panel section. The fold lines 32 are interrupted at the cutouts 36 by edges of the top panel section, forming tabs 52 which cover the tops of the protruding upper portions of the interior cans in a carrier formed from the blank. The lower bevel panel portion fold lines 22 are interrupted by short slits 54 which extend to the cutouts 26 to form tabs 56 which apply pressure against the heel portions of the bottles in a carrier.

Connected to the lower bevel panel portions of the side panel sections by the fold lines 24 are bottom panel flaps 58 and 60. The bottom panel flap 60 includes fold line 62 to which secondary locking tabs 64 are connected. A slit 66 interrupts the fold line 62 at each locking tab to form primary locking tabs 68. In addition, each secondary locking tab 64 includes a transverse fold line 70, creating an outer tab portion 72. The bottom panel flap 58 includes primary locking openings 74 and secondary locking slits 76 aligned with the locking tabs 68 and the locking tab portions 72.

Still referring to FIG. 5, the end edges of the top panel section 16 are defined by slits 77 which separate the top panel section from the end panel sections 38 and which terminate short of the corners of the top panel section. Cutouts 78, located at each corner of the top panel section, are defined by the corner edges of the top panel section, the edges 80 of the top bevel panel sections 28, the continuing edge 82 extending into the side panel sections, the free edge of the triangular panel 46 and the free edge of tuck panel 84. The tuck or connecting panels 84 are connected to the side panel sections along the fold lines 40 and to the triangular panels 46 along the fold line 86. The opposite edges 78 of the end panel sections are recessed slightly from the end edges of the side panel sections to compensate for the thickness of the end panel sections so that after the folding operations, which are explained more fully below, the outer face of the end panels is substantially in the same plane as the adjacent ends of the side panels. Each angled fold line 44 extends from an end of the slit 77 to the recessed end of the end panel section 38. Although the fold lines 44, 86 and 40 could all terminate at the same point, it is preferred that the fold line 86 terminate at a spaced point on the fold line 40 in order to avoid bunching of the material when folded.

Figure 6:
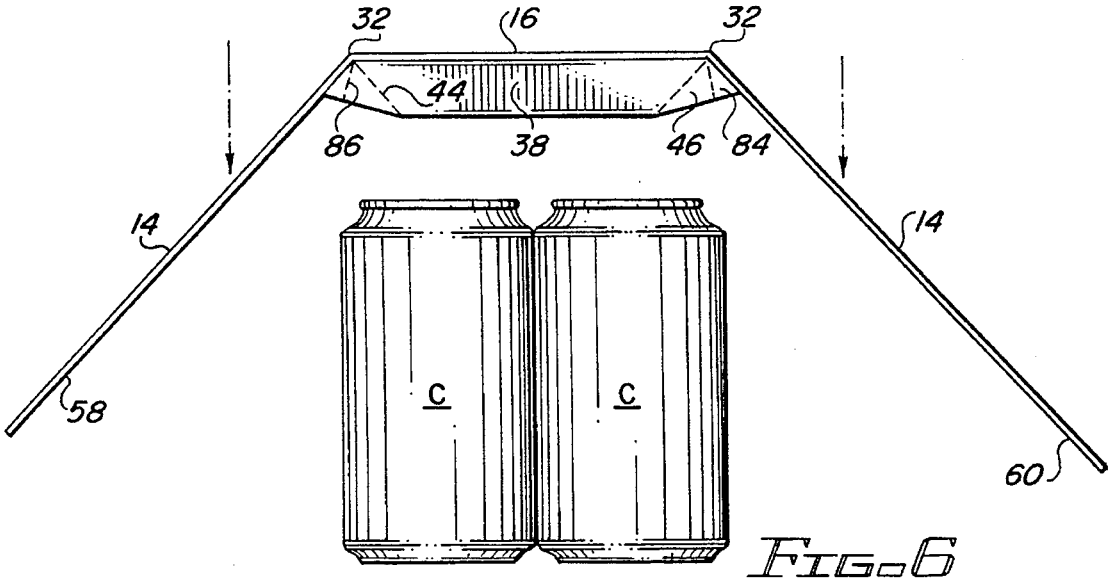
FIG. 6 is an end view of the carrier blank at initial stage of carrier formation.

Referring now to FIG. 6, to form a package the cans are arranged in a group of six and the blank is positioned so that the tabs 52 of the top panel section are aligned with the tops of the interior cans of the group. The side panel sections 14 are then pivoted down about the fold lines 32 while at the same time initiating the downward folding of the end panel sections 38, the triangular panels 46 and the tuck panels 84 as a unit about the fold lines 40. Because the fold lines 40 are at an angle to the fold lines 32, the continued folding of the side panel sections causes the end-panel elements 38, 46 and 84 to pivot down as a unit out of the plane of the top panel section. It will be appreciated that these elements have only been partially folded at the point in the process illustrated in FIG. 6.

Figure 7:
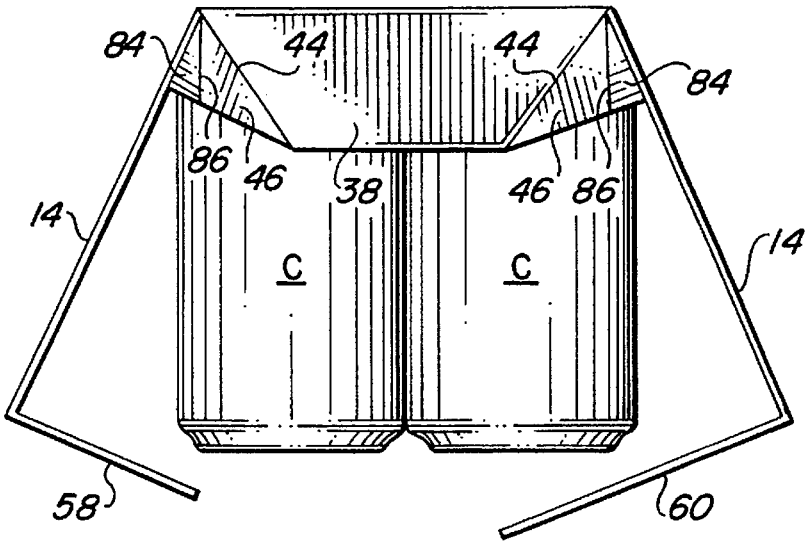
FIG. 7 is an end view similar to that of FIG. 6, but at a later stage of carrier formation.
Figure 8:
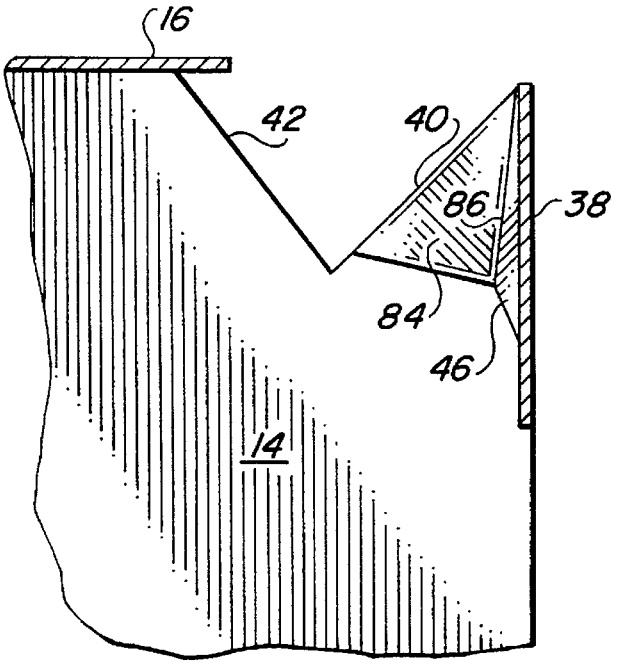
FIG. 8 is an enlarged partial sectional view taken along line 8—8 of FIG. 4, with the beverage cans omitted for the purpose of clarity.

Continued folding of the side panel sections brings the side panel sections closer to each other, which eventually causes the tuck panels 84 to pivot about the fold lines 40 toward the side panel sections and the triangular panels 46 to fold about the fold lines 44 and 86 so as to form obtuse angles with the adjacent side panel section 38 and tuck panel 84. A point in this later phase of the carrier forming operation is illustrated in FIG. 7. Eventually, when the side panel sections have been folded in against the cans, the tuck panels 84 will have pivoted in to substantially face the side panels. At this point at least a portion of the tuck panels are in contact with a portion of the adjacent can, thereby locking the end panels in place. The position of the tuck panels 84 at this point is shown in FIG. 8. The triangular panels 46 may be considered to be part of the end panels, with the fold lines 44 serving to permit the major portion of the end panels, indicated by reference numeral 38, to lie in a substantially vertical plane.

To complete the formation of the carrier the bottom panel flaps are folded in and connected to each other to form the bottom panel, resulting in the package of FIG. 1. In the design illustrated, the bottom panel flaps are connected by inserting the primary locking tabs 68 through the openings 74 and maintaining the primary locking tabs in locked position by inserting the outer tab portions 72 of the secondary locking tabs into the slits 76. It should be understood that the invention does not require that this particular bottom flap locking means, or any mechanical fastening means, be employed. As an alternative, the bottom panel flaps could be glued together.

It can now be appreciated that the invention provides a number of advantages. Partial end panels are provided from a blank of normal size by forming the end panels from material which normally would have been part of the top panel, thus not adding to the cost of the carrier. The end panel connection to the side panels results in a strong stable end panel construction, particularly since the end cans in the carrier lock the end panels in place as a result of pinching the tuck panels against the side panels. The end panels thus assist in preventing outward movement of the cans while also covering the price code on the cans.

Although the invention is not limited to the packaging of beverage cans, it will be understood that in order to obtain the benefit of covering the pricing code on the end articles in the package, the article should be of the type which carries the pricing code closer to the top of the article than the bottom. Inasmuch as the end panels are formed from portions which normally are part of the top panel, the height of the end panels is limited to a distance which does not excessively reduce the length of the top panel, since enough of the top panel must remain in order to adequately wrap the blank around the articles.

It should be understood that although the invention has been described in connection with the packaging of six articles, the carrier design can readily be modified to permit the packaging of fewer or more articles.

It should also be understood that changes to certain features and aspects of the design which do not affect the overall basic function and concept of the invention may be made by those skilled in the art without departing from the spirit and scope of the invention, as defined by the appended claims.

What is claimed is:

1. A package comprised of a wrap-around carrier containing a plurality of articles, comprising:

a top panel having opposite side edges and opposite end edges;

opposite side panels foldably connected to the side edges of the top panel;

a bottom panel connected to the side panels;

opposite end panels;

the end edges of the top panel being spaced from the end panels;

a connecting panel connected by a fold line to opposite end portions of each end panel, each connecting panel being connected by a diagonal fold line to a side panel, at least a portion of the connecting panel being in contact with an adjacent article and being located between the adjacent article and the associated side panel;

each side panel including opposite upper ends, the diagonal fold line of each connecting panel extending substantially to the upper end of an associated side panel; and the side panels including cutouts between the end edges of the top panel and the end panels, the fold line connecting each connecting panel to an associated side panel coinciding with an outer edge of the cutout in said side panel.

2. A blank for forming a wrap-around carrier for packaging a plurality of articles, comprising:

a centrally located top panel section having opposite side edges and opposite end edges;

a side panel section connected to each side edge of the top panel section by a fold line;

a bottom panel flap connected to at least one of the side panel sections;

opposite end panel sections adjacent the opposite end edges of the top panel section, each end panel section being separated from an associated end edge of the top panel section by a slit;

a connecting panel connected by a fold line to opposite end portions of each end panel section, each connecting panel being connected by a diagonal fold line to an associated side panel section; and the side panel sections including cutouts extending from the top panel section to a point adjacent to each connecting panel, the edges of a connecting panel and an associated end panel section forming an edge of each cutout.

3. A blank as defined in claim 2, wherein each end panel section includes diagonal fold lines extending from points located at or closely adjacent to the opposite end portions of associated side panel sections.

4. A package comprised of a wrap-around carrier containing a plurality of articles, comprising:

a substantially planar top panel having opposite side edges and opposite end edges;

opposite side panels foldably connected to the side edges of the top panel;

a bottom panel connected to the side panels;

opposite end panels, each end panel having an upper edge lying substantially in the plane of the top panel;

the end edges of the top panel being spaced from the upper edges of the end panels; and a connecting panel connected by a fold line to opposite end portions of each end panel, each connecting panel being connected by a diagonal fold line to a side panel, at least a portion of the connecting panel being in contact with an adjacent article and being located between the adjacent article and the associated side panel.

5. A package as defined in claim 4, wherein each side panel includes opposite upper ends, the diagonal fold line of each connecting panel extending substantially to the upper end of an associated side panel.

6. A package as defined in claim 5, wherein each end panel includes diagonal fold lines extending inwardly from a point substantially located at the upper end of an associated side panel.

7. A package as defined in claim 5, wherein the side panels include cutouts between the end edges of the top panel and the end panels and the side panels include upper bevel panel portions which are spaced from the upper ends of the side panels, the top panel being connected to the upper bevel panel portions between the cutouts in the side panels.

8. A package as defined in claim 4, wherein the end panels have a height substantially equal to the distance that the end edges of the top panel are spaced from the upper end of an associated end panel.

9. A package as defined in claim 8, wherein the carrier contains two adjacent rows of beverage cans.

* * * * *